US008061707B2

(12) United States Patent
Sugishima

(10) Patent No.: US 8,061,707 B2
(45) Date of Patent: Nov. 22, 2011

(54) PAPER SUPPLY APPARATUS AND IMAGE FORMING APPARATUS EQUIPPED WITH THE SAME

(75) Inventor: Yoshio Sugishima, Osaka (JP)

(73) Assignee: Kyocera Mita Corporation (JP)

( * ) Notice: Subject to any disclaimer, the term of this patent is extended or adjusted under 35 U.S.C. 154(b) by 20 days.

(21) Appl. No.: 12/553,572

(22) Filed: Sep. 3, 2009

(65) Prior Publication Data

US 2010/0059928 A1 Mar. 11, 2010

(30) Foreign Application Priority Data

Sep. 9, 2008 (JP) ..... 2008-230468

(51) Int. Cl.
*B65H 1/26* (2006.01)
*B65H 1/30* (2006.01)

(52) U.S. Cl. ..... 271/164; 271/162; 271/145; 399/393

(58) Field of Classification Search ..... 271/164, 271/162, 145; 399/393; 312/332.1
See application file for complete search history.

(56) References Cited

U.S. PATENT DOCUMENTS 5,294,106 A * 3/1994 Takagi et al. ..... 271/164
5,918,875 A * 7/1999 Masley et al. ..... 271/162
7,731,180 B2 * 6/2010 Ohnishi ..... 271/164

FOREIGN PATENT DOCUMENTS

JP 60082540 A * 5/1985
JP 10-101327 4/1998

* cited by examiner

*Primary Examiner* — Stefanos Karmis
*Assistant Examiner* — Luis A Gonzalez
(74) *Attorney, Agent, or Firm* — Gerald E. Hespos; Michael J. Porco

(57) ABSTRACT

A paper supply apparatus for conveying paper to an image forming apparatus has a paper accommodating unit to accommodate paper and to be drawn out from an accommodating space in a main body of the image forming apparatus. The apparatus also has a handle to rotate about an axis extending in the width direction of the paper in the paper accommodating unit. The handle includes a first edge that moves toward the paper accommodating unit upon rotation of the handle and a second edge that opposes the first edge. A link on the first edge of the handle releases engagement with the main body when the first edge moves toward the paper accommodating unit. A flapper is disposed on the second edge of the handle and forms a point where a force acts to move the first edge toward the paper accommodating unit.

9 Claims, 10 Drawing Sheets

PAPER SUPPLY APPARATUS AND IMAGE FORMING APPARATUS EQUIPPED WITH THE SAME

BACKGROUND OF THE INVENTION

1. Field of the Invention

The present invention relates to a paper supply apparatus which is used in a copying machine, printer, facsimile or the like, and to an image forming apparatus equipped with the paper supply apparatus.

2. Description of the Related Art

A paper supply apparatus such as a paper supply cassette apparatus comprises a paper accommodating unit configured to accommodate stacked paper sheets and to be drawn out from the main body of an image forming apparatus (see, for example, Japanese Patent Application Publication No. H10-101237). The paper supply cassette apparatus comprises an outer plate, which is observed outside the main body, and a handle between this outer plate and the paper accommodating unit. The handle is configured to engage the cassette with the main body. When the user pulls the cassette toward the outer side of the main body, the paper accommodating unit is opened to the outside. On the other hand, when the cassette is pushed toward the inside of the main body, then the paper accommodating unit is closed.

The paper in the paper accommodating unit is supplied out toward the interior of the main body at a prescribed conveyance pressure. Therefore, the cassette has to be accurately installed on the main body. For example, a hook locking mechanism provided on the upper end of the handle may work for accurate installation of the cassette on the main body. When the upper end of the handle with the hook locking mechanism is moved toward the paper accommodating unit, the engagement between the hook locking mechanism and the main body is released so that the user may draw the cassette out from the main body.

The hook locking mechanism, which is required for accurate installation of the cassette, may prevent the user from intuitively operating the cassette such as just simply drawing out it because the user has to insert his/her finger tips into the lower end of the outer plate, and then grip the handle with his/her index finger to unlock the hook locking mechanism with pressing the outer plate with his/her thumb in order to draw out the cassette when he/she tries to open the paper accommodating unit. In addition, an insufficient force onto the outer plate, an insufficient gripping force to the handle or a case that user grips the handle at a wrong position far from the prescribed adequate position may result in a failure in unlocking the hook locking mechanism.

SUMMARY OF THE INVENTION

The object of the present invention is to provide a paper supply apparatus and an image forming apparatus equipped with the same whereby the problems described above are resolved to achieve a intuitive operation so as to just simply draw out the cassette.

The paper supply apparatus relating to one aspect of the present invention which achieves the above-mentioned object comprises: a paper accommodating unit configured to accommodate the paper and to be drawn out from an accommodating space defined in a main body of the image forming apparatus; a handle configured to rotate about an axis extending in the width direction of the paper accommodated in the paper accommodating unit, the handle including a first edge which moves toward the paper accommodating unit in accordance with the rotation of the handle and a second edge which opposes the first edge; a linking mechanism on the first edge of the handle, the linking mechanism configured to release engagement with the main body when the first edge moves toward the paper accommodating unit; and a flapping member on the second edge of the handle, wherein the flapping member defines a point where a force acts so as to move the first edge toward the paper accommodating unit.

Furthermore, the image forming apparatus relating to another aspect of the present invention has a paper supply apparatus with the above-described features.

BRIEF DESCRIPTION OF THE DRAWINGS

FIG. 10 shows release between the main body and the hook locking mechanism.

DETAILED DESCRIPTION OF THE PREFERRED EMBODIMENTS

Below, an embodiment of the present invention will be described with reference to the drawings.

The term "width direction of the paper" used in the description given below means a direction perpendicular to a moving direction of the paper conveyed inside the image forming apparatus. Furthermore, the terms "front", "rear", "right", "left", "upper", "lower" and similar terms indicating directions which are used in the following description to facilitate understanding of the present invention do not limit the scope of the present invention in any way. Furthermore, in the following description, separate sheet paper is used as the paper, but paper which is wound in the form of a roll, or the like, for example, may be included in the term "paper".

Figure 1:
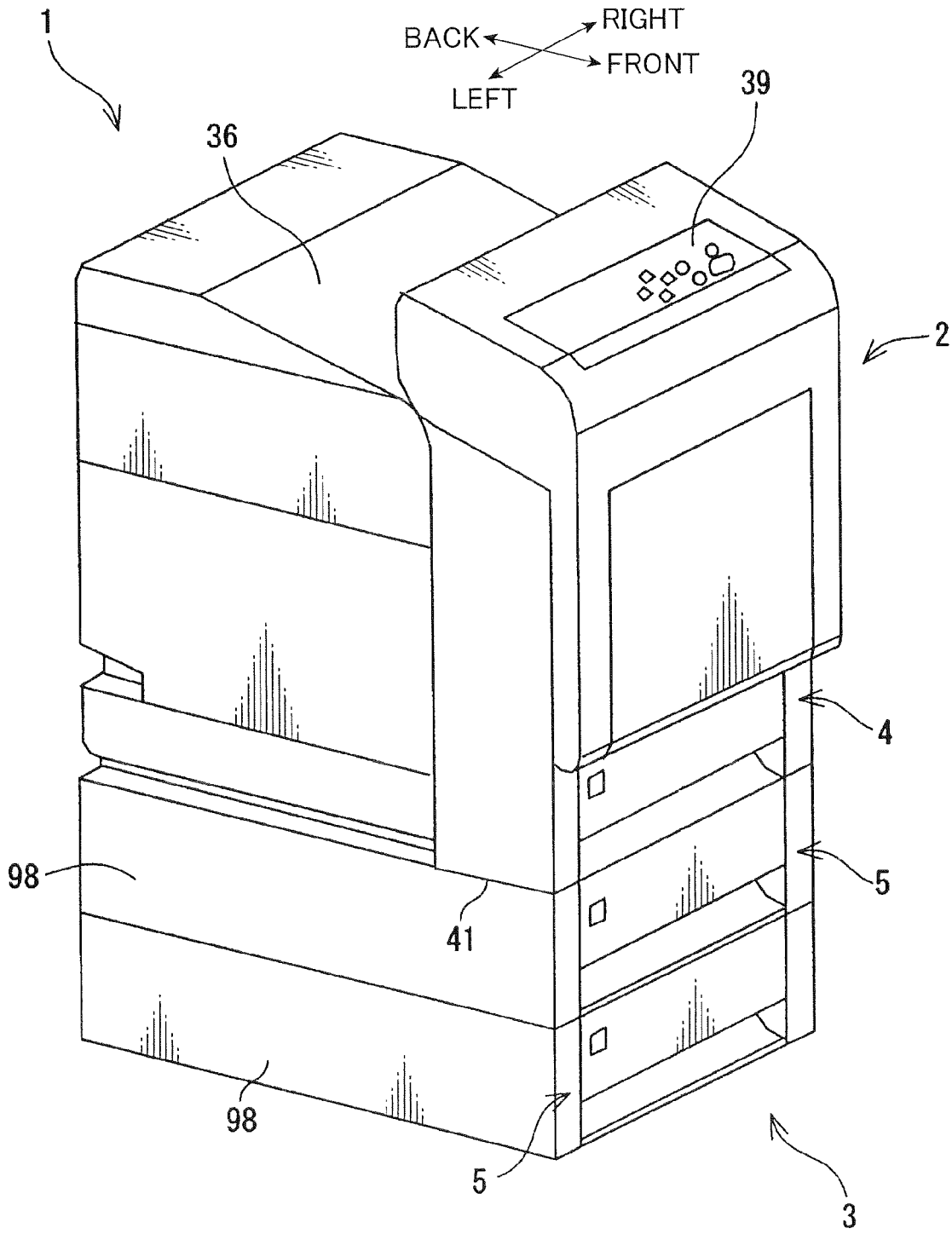
FIG. 1 is an external perspective diagram of a printer which incorporates the paper supply apparatus relating to one aspect of the invention.

FIG. 1 shows a printer 1 capable of color printing, as one embodiment of an image forming apparatus. In FIG. 1, the printer 1 is shown from the left front upper side so that the front surface to which a user faces and left side surface of the printer 1 is observed. The printer 1 comprises the main body 2 of an image forming apparatus. The paper discharge tray 36 is positioned in the upper portion of the main body 2.

As shown in FIG. 1, an operating display unit 39 is provided in the front of the paper supply tray 36. The operating display unit 39 may include a plurality of operating keys used for several kinds of user's operations and a screen configured to display various information.

An accommodating space configured to accommodate a paper supply cassette apparatus (paper supply apparatus) 3 is defined in the lower portion of the main body 2. FIG. 1 shows a paper supply cassette apparatus 3 inside the accommodating space. The cassette apparatus 3 according to the present embodiment comprises a standard cassette 4 installed in the main body 2 and two auxiliary cassettes (paper supply units) 5 configured to be detachably installed in the main body 2. In the embodiment shown in FIG. 1, two auxiliary cassettes 5 are provided below the standard cassette 4.

Stacked paper (for example, coated paper) is accommodated inside the cassettes 4 and 5. Apart from coated paper, the cassettes 4 and 5 may accommodate various types of papers such as copier paper, high-quality paper, cardboard, OHP sheets, and the like.

Figure 2:
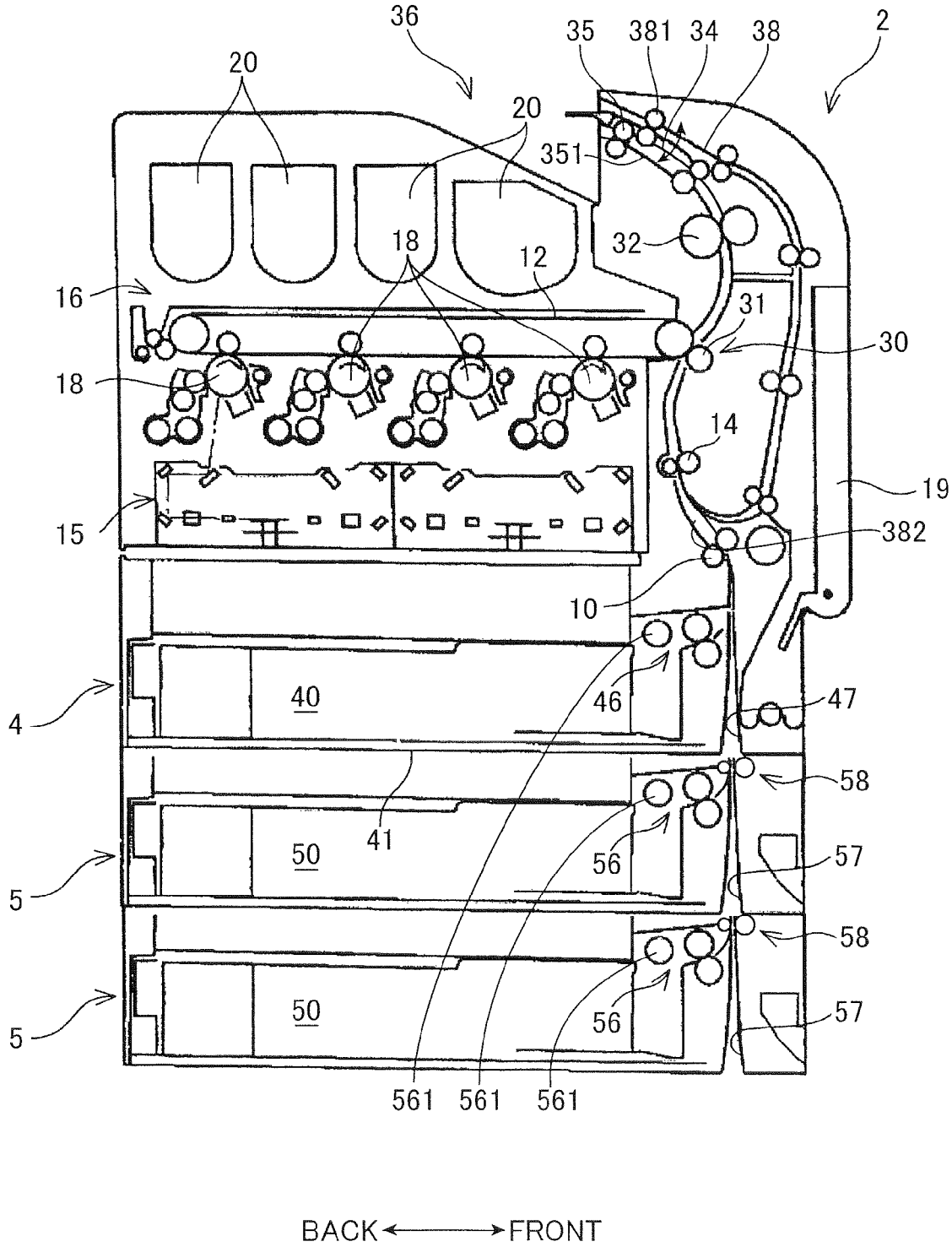
FIG. 2 is a schematic drawing of the printer shown in FIG. 1.

As shown in FIG. 2, the cassettes 4 and 5 respectively comprise paper accommodating units 40 and 50. Paper supply/separating rollers 46 and 56 are provided respectively in the upper portion in front of the accommodating units 40 and 50.

Paper passages 47 and 57 are defined in front of the respective rollers 46 and 56. The paper passages 47 and 57 extend in the upward direction. The upper end of the lowermost paper passage 57 connects to the lower end of the paper passage 57 adjacent to the upper auxiliary cassette 5. The upper end of the paper passage 57 adjacent to the upper auxiliary cassette 5 connects to the lower end of the paper passage 47 adjacent to the standard cassette 4. The upper end of the paper passage 47 connects to the interior of the main body 2. Conveyance rollers (conveyance mechanisms) 58 are provided respectively on the upper ends of the passages 57 adjacent to the respective cassettes 5.

The paper sheets accommodated in the cassettes 4 and 5 are upwardly supplied in front of the cassettes 4 and 5. The paper thus supplied is upwardly conveyed along the paper passage 47 and/or 57.

The cassettes 4 and 5 are respectively configured to be drawn out in front of the printer 1 from the accommodating space formed in the main body 2. New papers or another type of papers may be refilled or replaced after the cassettes 4 and 5 are drawn out.

Inside the main body 2, a conveyance roller 10, a resist roller 14, an image forming unit 16 and a transfer unit 30 are disposed in sequence along the downstream of the paper conveyance direction with respect to the cassettes 4 and 5.

Four photosensitive drums 18 are aligned in the image forming unit 16. A light exposure unit 15 is disposed between the photosensitive drum 18 and the cassette 4. Laser light is irradiated respectively onto the drums 18 from the light exposure unit 15.

A transfer belt 12 is disposed above the respective drums 18. Four toner containers 20 are provided between the transfer belt 12 and the paper discharge tray 36. The respective containers 20 aligned in sequence from the rear side toward the front side of the printer 1 are a yellow container, a magenta container, a cyan container and a black container. The black container has the largest capacity.

The transfer unit 30 comprises a transfer roller 31 configured to press against the transfer belt 12 obliquely from below. A nip, in which a toner image formed from toner delivered from the respective toner containers 20 is transferred to a paper sheet, is defined between the transfer belt 12 and the transfer roller 31.

A fixing unit 32, a diverter 34, a discharge roller 35 and a discharge tray 36 are disposed in sequence along the downstream of the paper conveyance direction with respect to the transfer unit 30.

A conveyance path 38 for double-side printing is defined above the discharge path 351 which extends from the fixing unit 32 toward the discharge roller 35. The diverter 34 upwardly and downwardly rotates so as to switch the conveyance path of the paper supplied from the fixing unit 32. The diverter 34 shown in FIG. 2 is located in an upper position and guides the paper fed out from the fixing unit 32 toward the discharge roller 35. When the diverter 34 is downwardly rotated from the position shown in FIG. 2, the diverter 34 guides the paper fed out from the fixing unit 32 to the conveyance path 38 for double-side printing. The paper guided to the conveyance path 38 by the diverter 34 is directed to a switch-back roller 381 in the vicinity of the diverter 34. The switch-back roller 381 grips the paper guided by the diverter 34 and supplies the paper to the paper discharge tray 36 by a prescribed length. Thereupon, the switch-back roller 381 reversely rotates and returns the paper to the interior of the main body 2. The conveyance path 38 between the transfer unit 30 and a manual feed tray 19 connected to the front wall of the main body 2 extends downwardly, and then directs to the resist roller 14 with defining an arc path. Immediately before the resist roller 14, the conveyance path 38 connects to a conveyance path 382 extending from the paper passage 47 toward the resist roller 14.

Figure 3:
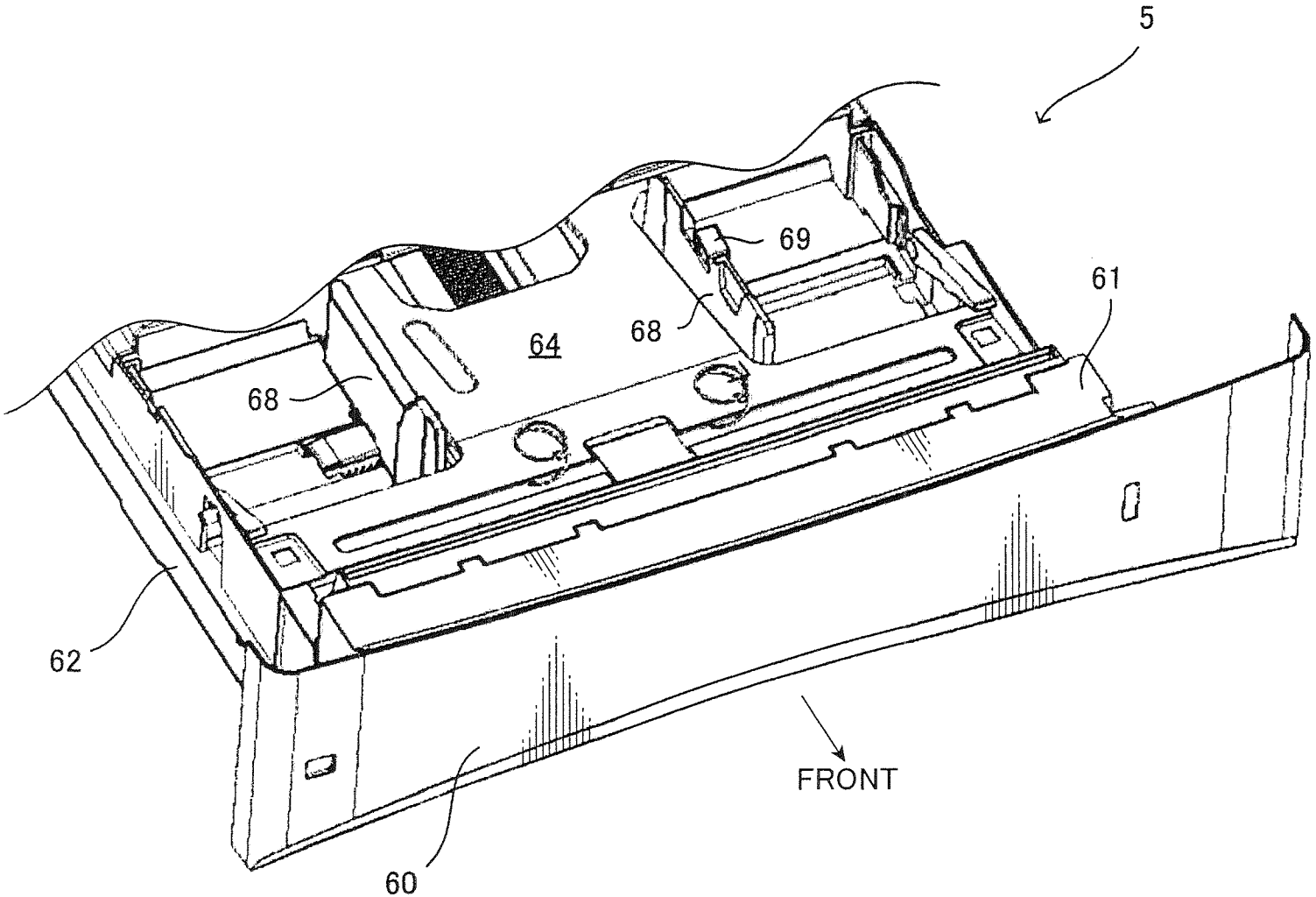
FIG. 3 is a partial perspective view of a cassette of the printer shown in FIG. 1.

FIG. 3 shows a part of the auxiliary cassette 5 in detail to explain a mechanism for applying a large conveyance pressure to the paper to be conveyed toward the conveyance path inside the main body 2.

As shown in FIG. 3, the cassette 5 comprises a paper accommodating unit 50 and an outer plate 60 which is connected to the paper accommodating unit 50. The paper accommodating unit 50 accommodates stacked papers. The outer plate 60 is disposed on the front side of the printer 1 (the front side of the cassette 5). The outer plate 60 extends in the width direction of the paper conveyed from the paper accommodating unit 50 and the outer surface of the outer plate 60 forms a part of the outer surface of the main body 2. Both ends of the outer plate 60 are held on an end section 61. The end section 61 is coupled to a base 62 of the paper accommodating unit 50. A bottom plate 64 is provided on the bottom of the base 62. Before printing, paper is stacked on the bottom plate 64. Lateral guides 68, 68 are provided respectively on both sides of the bottom plate 64. Each lateral guide 68 is provided with a knob 69. The lateral guides 68 become movable in the left/right direction of the printer 1 while the knob 69 is pressed.

Figure 4:
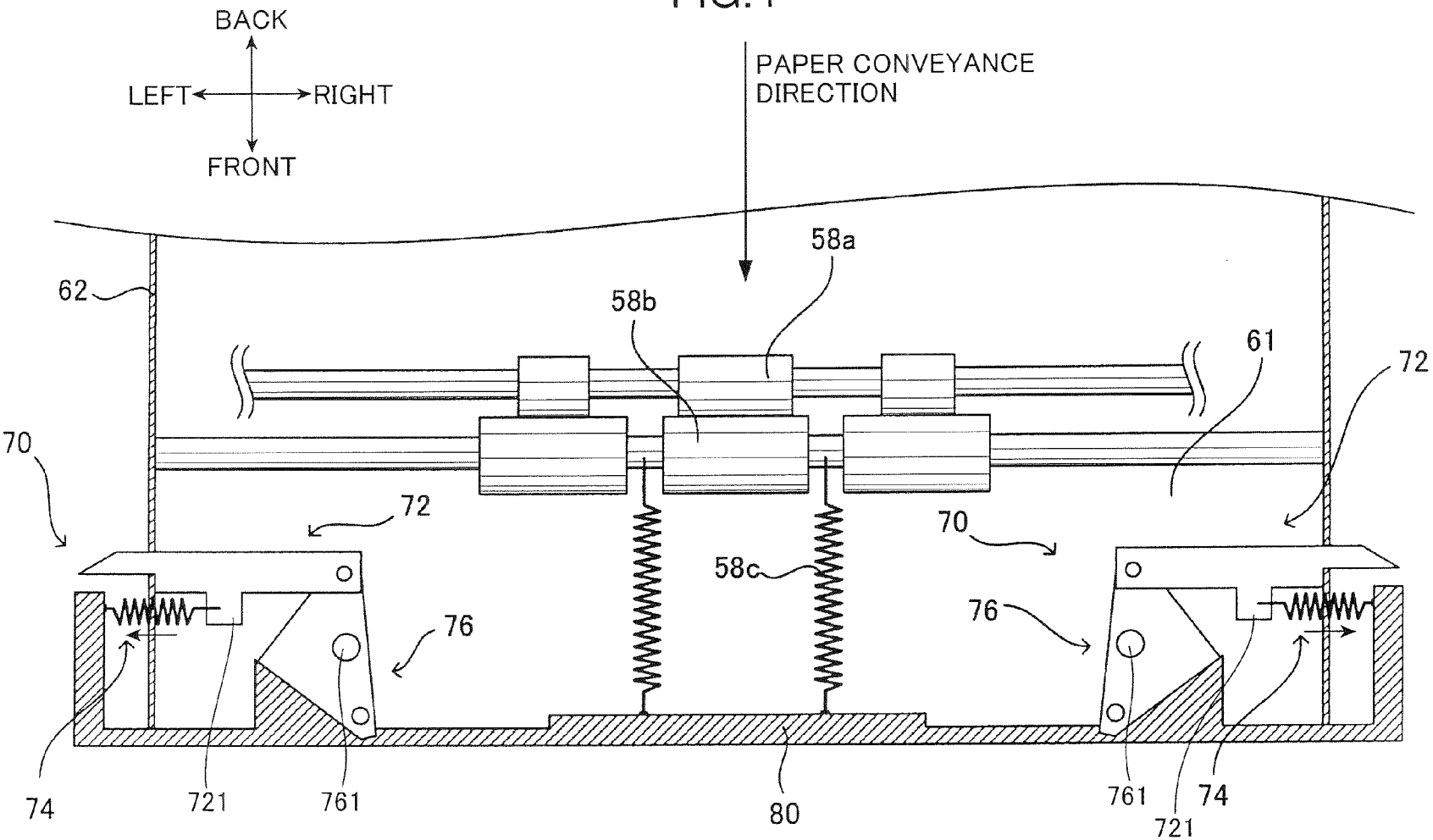
FIG. 4 is a plan view of the cassette shown in FIG. 3 and shows the cassette pushed into the main body; It should be noted that the outer plate is not depicted in FIG. 4.
Figure 5:
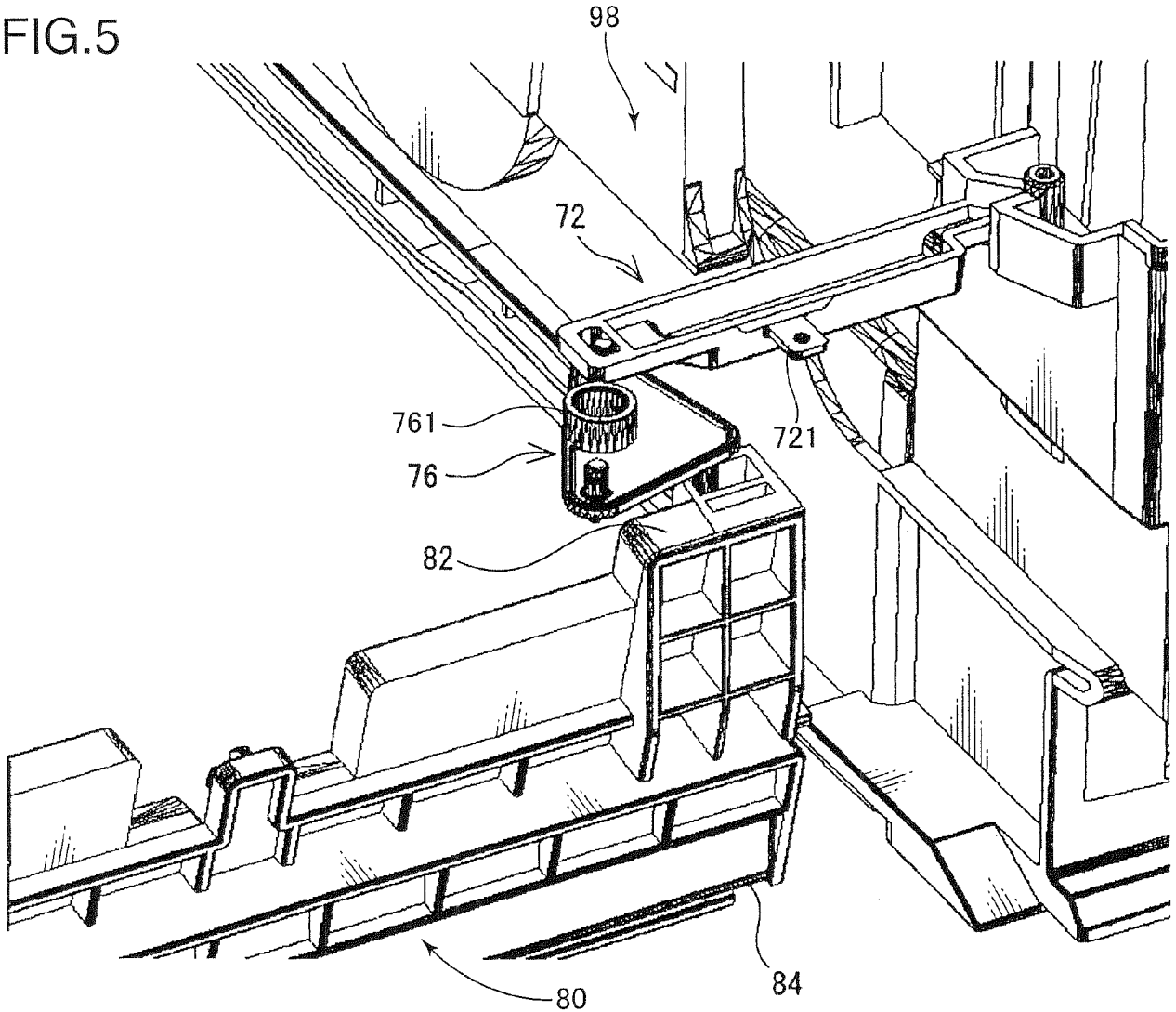
FIG. 5 is a perspective view of the cassette shown in FIG. 4 from the front side.
Figure 6:
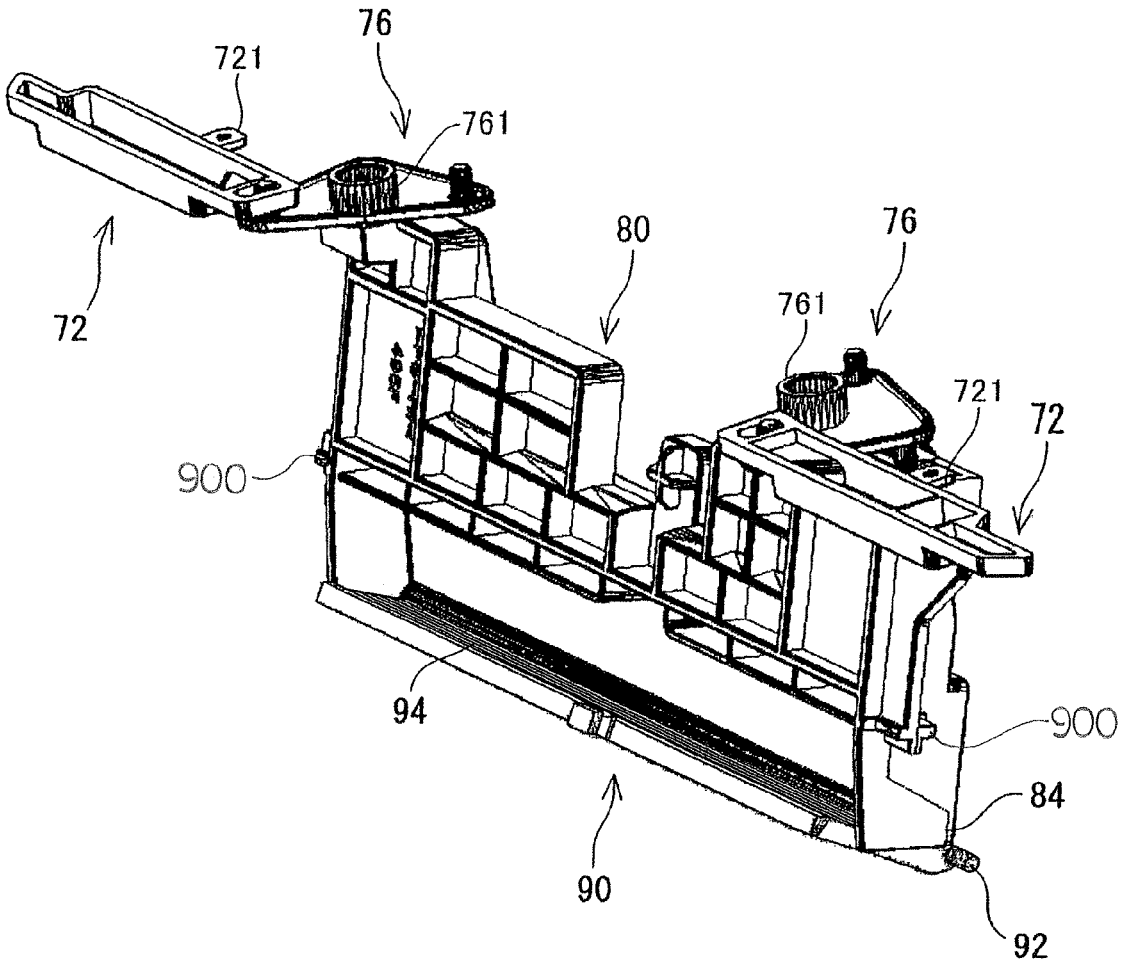
FIG. 6 is a perspective view of the cassette shown in FIG. 4 from the rear side.

FIG. 4 is a schematic diagram of a handle of the auxiliary cassette 5. FIG. 5 is a perspective view of the handle shown in FIG. 4 from the front side. FIG. 6 is a perspective view of the handle shown in FIG. 4 from the rear side. FIGS. 4 to 6 do not show the outer plate 60 to show the handle.

A handle 80 is formed on the interior side of the outer plate 60 (opposite to the outer surface of the outer plate 60). The handle 80 functions as a grip. The handle 80 is configured to rotate about an axis 900 extending in the width direction of the paper to be conveyed from the paper accommodating unit 50 (the left/right direction of the printer 1). At the same time as the lower edge (second edge) 84 of the handle 80 moves towards the outer plate 60 (the front surface of the printer 1), the upper edge (first edge) 82 of the handle 80 simultaneously moves toward the paper accommodating unit 50 (the rear side of the printer 1). The cassette 5 comprises a hook locking mechanism (linking mechanism) 70 configured to release the engagement between the cassette 5 and a surface of a substantially gateway-shaped cassette housing 98 (one of the surfaces defining the accommodating space) in the main body 2 (see FIG. 1 and FIG. 5) when the user rotates the handle 80 to draw out the cassette 5 from the housing 98.

Referring to FIG. 2, a paper supply/separating roller 56 is provided inside the cassette 5. The paper supply/separating roller 56 is positioned in the downstream side of the paper conveyance direction. The housing 98 comprises a pick-up roller 561 configured to contact the outermost paper of the paper stack in the cassette 5 and convey the paper toward the conveyance roller 58. The pick-up roller 561 is disposed on the central axis of the paper accommodating unit which extends in the forward/rear direction of the printer 1. Furthermore, the pick-up roller 561 is configured to rotate about an axis extending in the left/right direction of the printer 1.

Referring to FIG. 4, the cassette housing 98 and the cassette 5 support the conveyance roller 58. A driven roller (first conveyance roller) 58*a* is connected to the housing 98. The driven roller 58*a* is configured to rotate about an axis extending in a substantially parallel direction to the axis of the pick-up roller. The driven roller 58*a* may be rotated by a drive motor (not illustrated).

An idle roller (second conveyance roller) 58*b* is connected to the cassette 5. The idle roller 58*b* is configured to rotate about an axis extending in a substantially parallel direction to the axis of the drive side roller 58*a*. The idle roller 58*b* abuts strongly against the driven roller 58*a* due to a biasing force of a spring 58*c* while the cassette 5 is installed at an accurate position inside the housing 98. The idle roller 58*b* turns idly with the rotation of the driven roller 58*a* while the idle roller 58*b* abuts against the drive side roller 58*a*. The rollers 58*a* and 58*b* cooperate to supply paper one by one out from the paper supply/separating roller 56 toward the main body 2 with a prescribed conveyance pressure.

Hook locking mechanisms (linking mechanisms) 70 are provided on the upper edge 82 of the handle 80. The hook locking mechanisms 70 on the left side and right side of the cassette 5 engage the left and right ends of the cassette 5 with the housing 98. Each of the hook locking mechanisms 70 includes a hook 72. The hook 72 on the right side of the cassette 5 extends towards the right and the hook 72 on the left side of the cassette 5 extends towards the left. The distal end of each hook 72 tapers. While the cassette 5 is placed in the housing 98, the distal ends of the hooks 72 engage with the surface of the housing 98 (one of the surfaces defining the accommodating space) in which the cassette 5 is securely installed (see FIG. 5 and FIG. 6).

A projection 721 toward the handle 80 is formed in the central portion of each hook 72. One end of a spring (elastic member) 74 is attached to the projection 721. The spring 74 extends in the left/right direction of the printer 1. The other end of the spring 74 is attached to a prescribed position of the cassette 5 so that the spring 74 biases the hook 72 toward the surface of the housing 98 (one of the surfaces defining the accommodating space) (in a direction away from the central line of the paper accommodating unit 50).

The proximal end of the hook 72 is coupled to a rotatable plate 76. The rotatable plate 76 may be formed as a right-angle isosceles triangular plate. One of acute corners of the rotatable plate 76 is coupled to the proximal end of the hook 72. The rotatable plate 76 may include a rotating shaft 761 in a substantially central position of the rotatable plate 76. The rotating shaft 761 passes through the rotatable plate 76 (see FIG. 5 and FIG. 6). The rotating shaft 761 is supported rotatably on the upper edge 82 of the handle 80.

Figure 7:
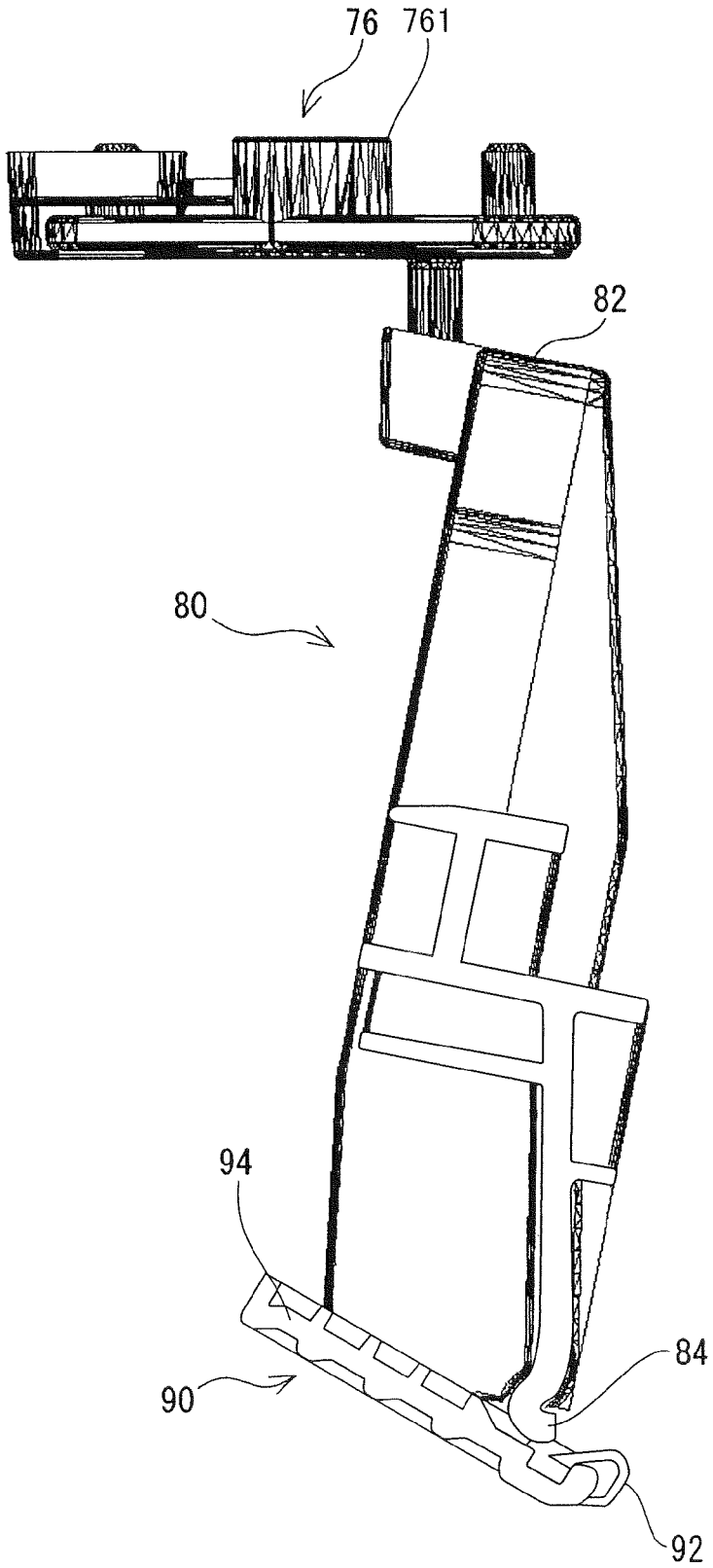
FIG. 7 is a partial cross-sectional view of the cassette shown in FIG. 4 from the left side.

Referring to FIG. 6 and FIG. 7 which is a partial cross-sectional diagram of the handle shown in FIG. 4 from the left side, a flapper (flapping member) 90 is provided on the lower edge 84 of the handle 80 according to the present embodiment. The flapper 90 may include a shaft 92. The distal end of the shaft 92 is supported rotatably on the lower edge 84 of the handle 80.

FIG. 7 shows the flapper 90 onto which any force is not applied. In this case, the shaft 92 is connected to a plate 94 projecting from the handle 80 toward the paper accommodating unit 40. The plate 94 extends in the left/right direction of the cassette 4 and abuts against the rear surface of the handle 80.

Figure 10:
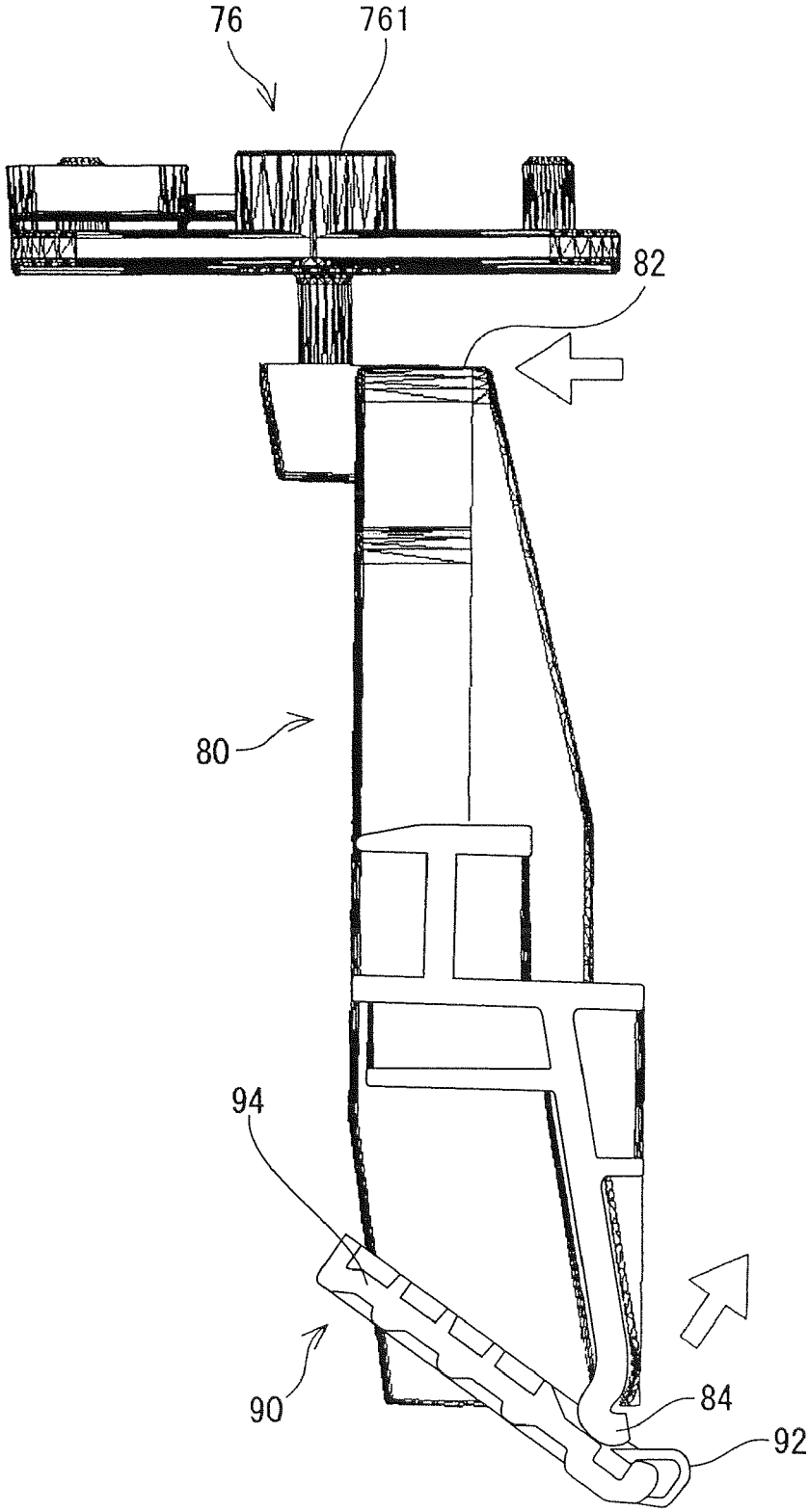
FIG. 10 is a partial cross-sectional diagram of the cassette shown in FIG. 4 from the left-hand side.

Referring to FIG. 7 and FIG. 10 which is a partial cross-sectional diagram of the handle shown in FIG. 4 from the left side and shows the moment of release between the housing 98 and the hook locking mechanism, when the user's finger touches the lower surface of the plate 94 to draw out the cassette 5, the shaft section 92 rotates slightly in the clockwise direction about the lower edge 84 of the handle 80, and pushes the lower edge 84 of the handle 80 up towards the outer plate 60, as indicated by the arrow pointing obliquely upwardly and rightwards in FIG. 10. Simultaneously the upper end 82 of the handle 80 moves toward the rear side of the printer 1, as indicated by the arrow pointing leftwards in FIG. 10.

Figure 8:
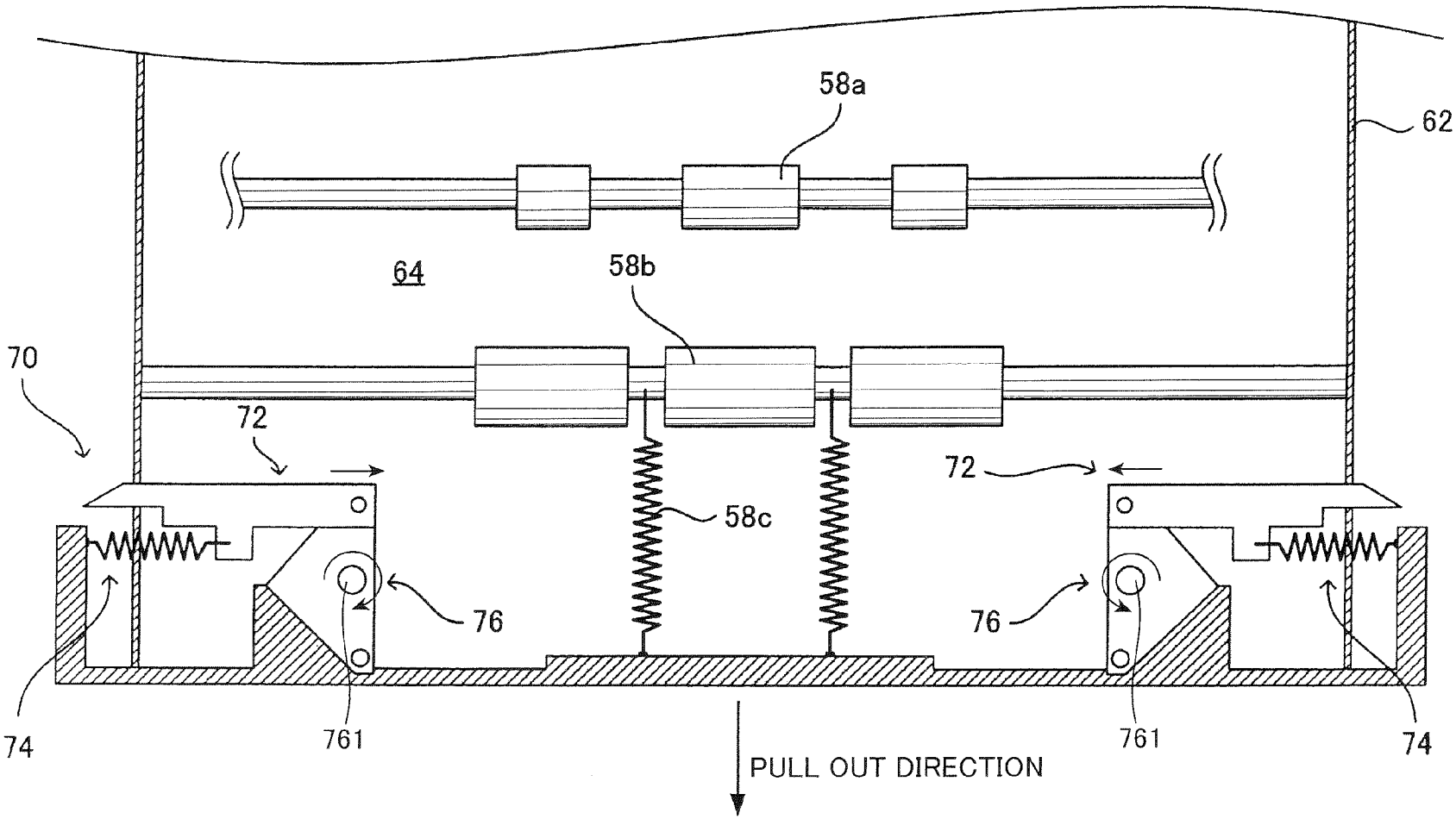
FIG. 8 is a plan view of the cassette shown in FIG. 3 and shows the cassette drawn out from the main body; It should be noted that the outer plate is not depicted in FIG. 8.
Figure 9:
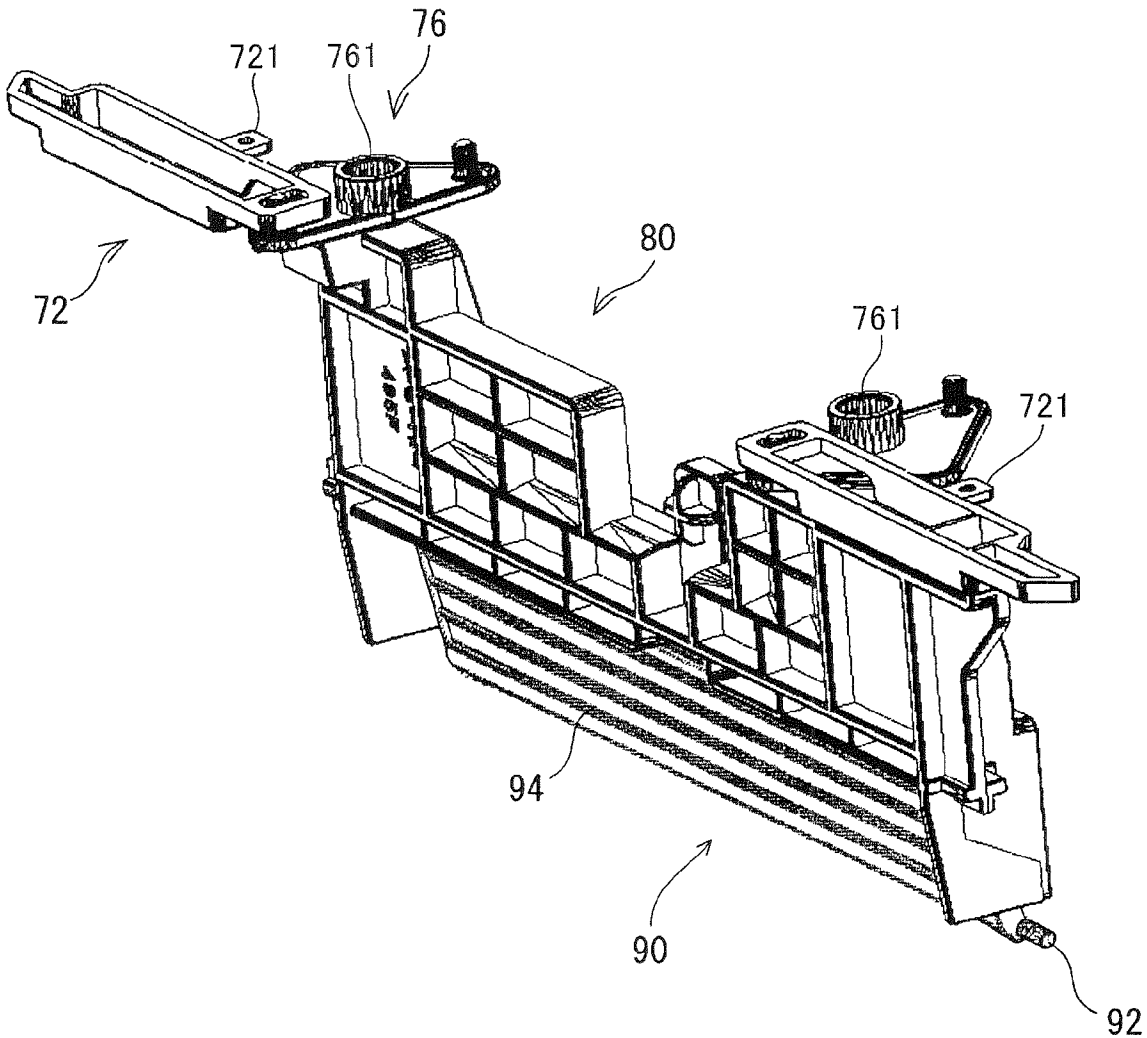
FIG. 9 is a perspective view of the cassette shown in FIG. 8 from the rear side.

Explanation will be given with reference to FIG. 8 and FIG. 9. FIG. 8 is a plan diagram of the cassette shown in FIG. 3. It should be noted that the outer plate is not depicted in FIG. 8. Furthermore, the cassette shown in FIG. 8 is drawn out from the main body 2. FIG. 9 is a perspective view of the cassette shown in FIG. 8, from the rear side.

During the operation described in relation to FIG. 7 and FIG. 10, the left rotatable plate 76 rotates in the clockwise direction about the rotating shaft 761, and furthermore the right rotatable plate 76 in the counter-clockwise direction about the rotating shaft 761. Simultaneously the hooks 72, 72 move toward the central line of the paper accommodating unit 40 against the biasing force of the spring 74, so that the engagement between the cassette 5 and the cassette housing 98 is released and the cassette 5 may be drawn out from the housing 98. The plate 94 returns to the position shown in FIG. 7 after the plate section 94 rotates until the upper surface of the plate 94 abuts against the rear surface of the handle 80 and the user's finger moves apart from the lower surface of the plate 94.

While the user pushes the cassette 5 into the housing 98, the cassette 5 moves toward the rear side of the printer 1. When the hooks 72, 72 make contact with a part of the housing 98, these hooks 72 move toward the central line of the paper accommodating unit 50 against the biasing force of the spring 74, and similarly to the description relating to FIG. 8, the left rotatable plate 76 rotates in the clockwise direction about the rotating shaft 761 and the right rotatable plate 76 rotates in the counter-clockwise direction about the rotating shaft 761.

Immediately before the hooks 72 engage with the housing 98, the hooks 72 move respectively in directions away from the central line of the paper accommodating section 50 due to the biasing force of the spring 74, so that the cassette 5 is engaged with the housing 98 as shown in FIG. 4, and the rollers 58*a* and 58*b* abut together firmly due to the biasing force of the spring 58*c*.

When the printer 1 in which the paper supply cassette apparatus 3 is fitted carries out printing, paper is fed out one by one from one of the cassettes 4 or 5. The supplied paper arrives at the resist roller 14 which straightens any skewed travel of the paper as well as feeding the paper to the transfer unit 30 in synchronism with the image transfer timing of the toner image formed on the image forming unit 16.

The image data on which the printed image depends is sent to the printer 1 from an external source. The image data may be data obtained by converting various types of images, such as text characters or numerals, figures, symbols, graphs, patterns, or the like. The irradiation of laser light is controlled by the light exposure unit 15 of the printer 1 on the basis of the image data, so that an electrostatic latent image corresponding to an original document image is formed on each drum 18, and then a toner image is formed from these electrostatic latent images.

This toner image is transferred onto the paper in the nip between the transfer belt 12 and the transfer roller 31. Thereafter, the paper with the transferred toner image is supplied to the fixing unit 32. The fixing unit 32 applies heat and pressure to the toner image to fix the toner image onto the paper. The paper supplied from the fixing unit 32 is discharged to the paper discharge tray 36 via the discharge roller 35 and is stacked on the paper discharge tray 36.

If double-sided printing is being performed, the conveyance path for the paper sent from the fixing unit 32 is switched by the diverter 34. One-side printed paper is sent back to the interior of the main body 2 and is conveyed to the conveyance path 38 for a double-side printing, and arrives at the upstream side of the resist roller 14. Thereupon, the paper is sent again from the resist roller 14 to the transfer unit 30 to transfer the toner image onto the surface of the paper where printing has not yet been carried out.

The auxiliary cassette 5 according to the present embodiment comprises a paper accommodating unit 50, an outer plate 60, a handle 80 and a hook locking mechanism 70. If the lower edge 84 of the handle 80 is moved toward the outer plate 60 (the upper edge 82 of the handle 80 is moved toward the paper accommodating unit 50), then the upper edge 82 of the handle 80 defines a point (force application point) where the handle 80 applies force to the hook locking mechanism 70, and the engagement between the hooks 72 and the cassette housing 98 may be then released.

A flapper 90 is provided on the lower edge 84 of the handle 80. The flapper 90 defines a point on the lower edge 84 where a force acts so as to move the upper edge 82 of the handle 80 toward the paper accommodating unit 50.

By defining the lower edge 84 of the handle 80 as the force acting point in this way (the point where the user's force acts on the handle 80), the user's force is rapidly transmitted to the force application point so that the lower edge 84 of the handle 80 moves toward the outer plate 60 as soon as the user inserts the tip or his or her hand at the lower end of the outer plate 60 and applies force to the flapper 90. For example, if the handle 80 is simply provided between the outer plate 60 and the paper accommodating unit without the flapper 90, and unless a force is intensively applied to the lower end 84 of the handle 80, user's force is not transmitted rapidly to the force application point. On the other hand, according to the present embodiment in which a flapper 90 is provided, the force applied to the flapper 90 is transmitted to the lower edge 84 of the handle 80 and then further transmitted directly from the lower edge 84 to the upper edge 82 of the handle 80, so that the engagement between the hooks 72 and the housing 98 is released quickly, which allows the user to quickly draw the paper accommodating unit 50 out from the housing 98 without gripping the handle 80 and the outer plate 60 in comparison with prior arts. In the present embodiment, what the user has to do for drawing out the cassette 5 is just to contact with the handle 80 to be pulled out. Therefore, the paper supply cassette apparatus even with hooks 72 according to the present embodiment achieves very similar operational feeling to a paper supply cassette apparatus without the hook 72. In other words, the present embodiment achieves an intuitive operational feeling such as simply drawing out the cassette 5. Moreover, the present embodiment unlocks the hook locking mechanism 70 reliably from the housing 98 because of no conventional issue in a wrong gripping position or an insufficient gripping force of the handle according to a conventional cassette with hook lock mechanism.

The paper in the standard cassette 4 close to the conveyance roller 10 is conveyed immediately to the conveyance path inside the main body of the apparatus 2 by this roller 10. Thus, the standard cassette does not require the conveyance mechanism 58 (see FIG. 2). On the other hand, the paper from the auxiliary cassette 5 has to receive a large conveyance force in order to arrive at the conveyance path inside the main body 2. Therefore the auxiliary cassette 5 is provided with the idle roller **58*b* and the locking mechanism 70. The idle roller 58*b* cooperate with the driven roller 58*a* to supply the outermost paper out of the paper accommodating unit 50 (near side to the outer plate 60) toward the inside of the main body 2** at a prescribed pressure.

The hook locking mechanism 70 comprises hooks 72 and springs 74. The hooks 72 are configured to move in the right/left direction of the printer 1 and engaging with the housing 98. The springs 74 biases the hooks 72 in a direction away from the central line of the paper accommodating unit 40. The hooks 72 engage with the housing 98 by moving in the left/right direction of the printer 1 due to the biasing force of the springs 74, which result in a stable position of the paper accommodating unit 50 with respect to the housing 98. Therefore, a larger conveyance pressure may be applied to the paper from the conveyance roller 58. Consequently, paper may be supplied reliably toward the conveyance path of the main body 2, which results in stabilization for paper supply.

Moreover, the plate 94 disposed in the rear end of the flapper 90 extends toward the paper accommodating unit 50 before pressure is applied to the flapper 90. Therefore, the user may touch the flapper 90 immediately upon the tip of the user's hand being inserted at the lower side of the outer plate 60. Consequently, the lower edge 84 of the handle 80 may immediately move toward the outer plate 60, in comparison with a structure without a flapper. Therefore, this feature also contributes to achieving an intuitive operational feeling.

Moreover, a cassette 5 according to the present embodiment may be constructed by adding a flapper 90 to a handle 80 of a conventional cassette, and therefore the manufacturing costs of the paper supply cassette apparatus 3 may be reduced and the overall cost of the printer 1 may also go down.

The present invention is not limited to the embodiment described above, and it is possible to implement various modifications without deviating from the claims. For example, in the embodiment described above, the flapper 90 and the hook locking mechanism 70, and the like, are provided in the auxiliary cassette 5, but the invention is not necessarily limited to this mode. It is also possible for the flapper 90, the locking mechanism 70, and the like, to be provided in the standard cassette 4. The terms "side of main body" or "cassette housing" used in the description given above include the main body 2 or the cassette housing 98 which support the side surface of the standard cassette 4, in a case where a flapper 90, locking mechanism 70 and the like are provided in the standard cassette 4.

Furthermore, in the embodiment described above, a printer is described as an image forming apparatus, but the image forming apparatus according to the present invention may also be employed in a copying machine, facsimile device, or the like.

The paper supply apparatus according to the above-mentioned embodiment comprises a paper accommodating unit configured to accommodate the paper and to be drawn out from an accommodating space defined in a main body of the image forming apparatus; a handle configured to rotate about an axis extending in the width direction of the paper accommodated in the paper accommodating unit, the handle including a first edge which moves toward the paper accommodating unit in accordance with the rotation of the handle and a second edge which opposes the first edge; a linking mechanism on the first edge of the handle, the linking mechanism configured to release engagement with the main body when the first edge moves toward the paper accommodating unit; and a flapping member on the second edge of the handle, wherein the flapping member defines a point where a force acts so as to move the first edge toward the paper accommodating unit.

According to the above-mentioned feature, if the first edge of the handle is moved toward the paper accommodating unit, then the first edge of the handle defines a point where the handle applies force to the link mechanism, and the engagement between the accommodating unit and the main body may be then released. A flapping member is provided on the second edge of the handle. The flapper defines a point on the second edge where a force acts so as to move the first edge of the handle toward the paper accommodating unit. By defining the second edge of the handle as the force acting point, the user's force is rapidly transmitted to the force application point as soon as the user applies force to the flapping member. Thus the present embodiment achieves an intuitive operational feeling.

In another embodiment, the paper supply apparatus is configured to be detachable from the main body.

In yet another embodiment, the main body includes a first conveyance roller configured to be disposed in the paper accommodating unit.

In yet another embodiment, the paper supply apparatus further comprises a second conveyance roller, wherein the second conveyance roller cooperates with the first conveyance roller to feed out the paper in an outermost paper stacked in the paper accommodating unit toward a conveyance path inside the main body.

In yet another embodiment, the linking mechanism includes: a hook in the paper accommodating unit, the hook configured to move in the width direction of the paper and engage with one surface defining the accommodating space of the main body; and an elastic member configured to bias the hook toward the one surface defining the accommodating space.

In yet another embodiment, the flapping member includes: a shaft rotatably supported on the second edge of the handle; and a plate configured to be connected to the shaft, the plate projecting in a direction to the paper accommodating unit while an external force is not applied to the plate.

The image forming apparatus according to the above-mentioned embodiment comprises the paper supply apparatus above-mentioned.

This application is based on Japanese patent application serial No. 2008-230468, filed in Japan Patent Office on Sep. 9, 2008, the content of which are hereby incorporated by reference.

Although the present invention has been fully described by way of example with reference to the accompanied drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A paper supply apparatus for conveying paper to an image forming apparatus, comprising:

a paper accommodating unit configured to accommodate the paper and to be drawn out from an accommodating space defined in a main body of the image forming apparatus;

a handle configured to rotate about an axis extending in a width direction of the paper accommodated in the paper accommodating unit, the handle including a first edge which moves toward the paper accommodating unit in accordance with the rotation of the handle and a second edge which opposes the first edge;

a linking mechanism on the first edge of the handle, the linking mechanism including a hook in the paper accommodating unit, the hook being configured to move in the width direction of the paper and engage with one surface defining the accommodating space of the main body, an elastic member configured to bias the hook toward the one surface defining the accommodating space, the linking mechanism being configured to release engagement with the main body when the first edge moves toward the paper accommodating unit; and a flapping member on the second edge of the handle, the flapping member defining a point where a force acts so as to move the first edge toward the paper accommodating unit.

2. The paper supply apparatus according to claim 1, wherein the paper supply apparatus is configured to be detachable from the main body.

3. The paper supply apparatus according to claim 1, wherein the flapping member includes:

a shaft rotatably supported on the second edge of the handle; and a plate configured to be connected to the shaft, the plate projecting in a direction to the paper accommodating unit while an external force is not applied to the plate.

4. The paper supply apparatus according to claim 3, wherein the plate rotates to hit the second edge near the shaft while the external force is applied to the plate.

5. An image forming apparatus comprising the paper supply apparatus according to claim 1.

6. A paper supply apparatus for conveying paper to an image forming apparatus, comprising:

a paper accommodating unit configured to accommodate the paper and to be drawn out from an accommodating space defined in a main body of the image forming apparatus;

a handle configured to rotate about an axis extending in a width direction of the paper accommodated in the paper accommodating unit, the handle including a first edge which moves toward the paper accommodating unit in accordance with the rotation of the handle and a second edge which opposes the first edge;

a linking mechanism on the first edge of the handle, the linking mechanism configured to release engagement with the main body when the first edge moves toward the paper accommodating unit; and a flapping member on the second edge of the handle, the flapping member defining a point where a force acts to move the first edge toward the paper accommodating unit, the flapping member including a shaft rotatably supported on the second edge of the handle and a plate configured to be connected to the shaft, the plate projecting in a direction toward the paper accommodating unit while an external force is not applied to the plate.

7. The paper supply apparatus according to claim 6, wherein the paper supply apparatus is configured to be detachable from the main body.

8. An image forming apparatus comprising the paper supply apparatus according to claim 6.

9. The paper supply apparatus according to claim 6, wherein the plate rotates to hit the second edge near the shaft while the external force is applied to the plate.

* * * * *